US005660558A

United States Patent [19]

Osanai et al.

[11] Patent Number: 5,660,558

[45] Date of Patent: Aug. 26, 1997

[54] SHIELDED CONNECTOR HAVING A SHELL WITH INTEGRAL LATCH ARMS

[75] Inventors: Yutaka Osanai; Hideyuki Ohtani; Yasufumi Hayashi, all of Tokyo, Japan

[73] Assignee: Japan Aviation Electronics Industry, Limited, Tokyo, Japan

[21] Appl. No.: 626,539

[22] Filed: Apr. 2, 1996

[30] Foreign Application Priority Data

Apr. 4, 1995 [JP] Japan ..... 7-078779

[51] Int. Cl.[6] ..... H01R 13/627

[52] U.S. Cl. ..... 439/353; 439/607

[58] Field of Search ..... 439/352, 353, 439/357, 358, 347, 607, 610

[56] References Cited

U.S. PATENT DOCUMENTS 5,162,000 11/1992 Frantz ..... 439/607

5,417,590 5/1995 Dechelette et al. ..... 439/607

*Primary Examiner*—P. Austin Bradley

*Assistant Examiner*—Yong Ki Kim

*Attorney, Agent, or Firm*—Laff, Whitesel, Conte & Saret, Ltd.

[57] ABSTRACT

In a shielded connector for being connected to a mating connector in a first direction, a metal shell (41) has a shielding portion (51) and a coupling portion (53) whichis formed integral with the shielding portion. The shielding portion covers an insulator (43) to electromagnetically shield contact members which are conductive. The coupling portion is for being mechanically coupled to the mating connector in the first direction. The dontact members are held to the insulator to be arranged in a second direction perpendicularto the first direction. The coupling portion is movable substantially in a third direction perpendicular to said first and said second directions.

4 Claims, 7 Drawing Sheets

SHIELDED CONNECTOR HAVING A SHELL WITH INTEGRAL LATCH ARMS

BACKGROUND OF THE INVENTION

This invention relates to a connector which is for use in connecting a cable with another cable or an electrical or electronic apparatus and is connected to a mating connector in a predetermined direction which will be called hereafter a first direction.

A cable of a shield type is known and will be called hereafter a shielded cable. In connection of the shielded cable, it is preferable to use a connector of a shield type which will be called hereinafter a shielded connector.

In the manner which will presently be described, a conventional shielded connector comprises an insulator, a plurality of contact members, and a shell. The contact members have conductivity and are held to the insulator to be arranged in a second direction or a width direction perpendicular to the first direction. The shell is made of a metal plate and held to the insulator to electro-magnetically shield the contact members.

Furthermore, the conventional shielded connector is provided with a locking structure which is for being mechanically coupled or locked to the mating connector in the first direction when the shielded connector is connected to the mating connector. In the manner Which will later be described in detail in conjunction with the drawing, the locking structure is broadly divided into a first and a second type. In the first type, the locking structure is formed as a separate body separate from a shell. In the second type, the locking structure is formed as an integral body integral with the shell.

In the locking structure of the first type, the number of parts is increased because the shell and the locking structure are separate components. Furthermore, it is necessary to carry out a particular process of assembling the locking structure.

In the locking structure of the second type, no such process of assembling the locking structure is required. However, the size of the shielded connector increases in the second direction. This is because the locking structure of the second type has two movable members which are moved in the second direction at a time when connection or disconnection is carried out between the connectors.

SUMMARY OF THE INVENTION

It is therefore an object of this invention to provide a shielded connector which is capable of reducing the number of parts and achieving miniaturization of the connector.

Other objects of this invention will become clear as the description proceeds.

According to this invention, there is provided a shielded connector for being connected to a mating connector in a first direction. The shielded connector includes an insulator, a plurality of contact members having conductivity and held to the insulator to be arranged in a second direction perpendicular to the first direction, and a shell made of a metal plate and held to the insulator. In the shielded connector, the shell comprises a shielding portion covering the insulator to electromagnetically shield the contact members, and a coupling portion formed integral with the shielding portion for being mechanically coupled to the mating connetor in the first direction. The coupling portion is movable substantially in a third direction perpendicular to the first and the second directions.

DESCRIPTION OF THE PREFERRED EMBODIMENT

At first, description Will be made as regards various conventional shielded connectors for a better understanding of this invention.

Figure 1:
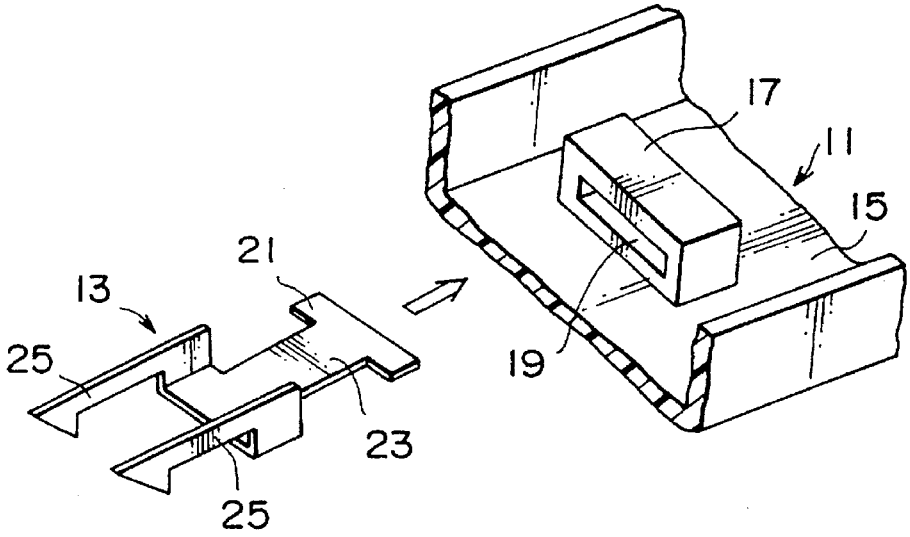
FIG. 1 PRIOR ART
FIG. 1 is a perspective view for describing a first conventional shielded connector.

Referring to FIG. 1, a first conventional shielded connector will be described. The first conventional shielded connector is for being connected to a mating connector (not shown) in a first direction. Although omission is carried out from FIG. 1, it is a matter of course that the first conventional shielded connector includes an insulator, a plurality of contact members having conductivity and held to the insulator to be arranged in a second direction perpendicular to the first direction, and a shell made of a metal plate and held to the insulator.

The first conventional shielded connector further comprises a hood 11 made of insulating material and covers the shell and a lock spring 13 formed as a separate body separate from the shell. The hood 11 has an upper wall 15 and a holding portion 17 formed thereon. The holding portion 17 has a holding hole 19 ektending parallel to the upper wall 15. On the other hand, the lock spring 13 has a locking portion 21, a spring portion 23, and a pair of hooks 25. The locking portion 21 is inserted into the holding hole 19 of the holding portion 17 to be tightly held therein. The hooks 25 are for being brought inengagement with locking holes of the mating connector in the first direction with elastic bending of the spring portion 23 when the first conventional shielded connector is connected to the mating connector.

Figure 2:
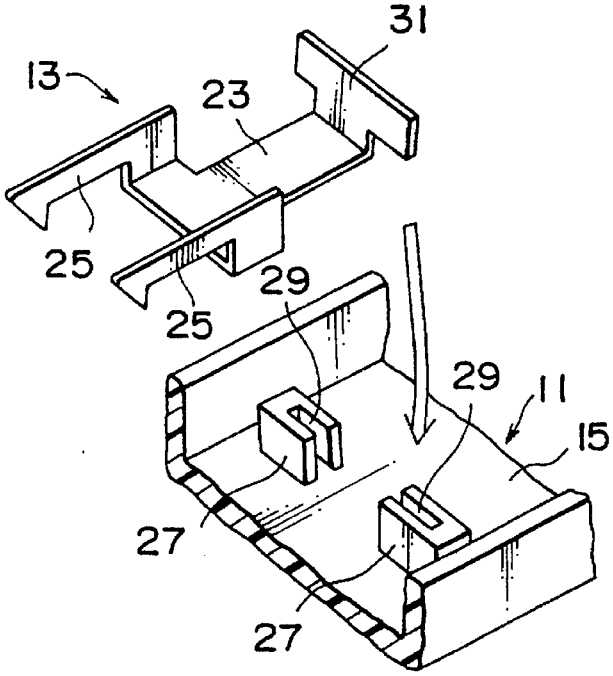
FIG. 2 PRIOR ART
FIG. 2 is a perspective view for describing a second conventional shielded connector.

Referring to FIG. 2, the description will be directed to a second conventional shielded connector. Similar parts are designated by like reference numerals.

In the second conventional shielded connector, the upper wall 15 of the hood 11 is provided with two holding portions 27. Each of the holding portions 27 has a socket groove 29 extending perpendicular to the upper wall 15. On the other hand, the lock spring 13 has an upstanding locking portion 31 in addition to the spring portion 23 and the hook 25. The upstanding locking portion 31 is formed at a rear end of the lock spring 13 to be inserted into the socket grooves 29. Thus, the lock spring 13 is attached to the hood 11.

Each of the first and the second conventional shielded connector makes the number of parts be increased because the shell and the lock spring 13 are separate components. Furthermore, this structure requires process of assembling and fixing the lock spring 13 to the hood 11.

Figure 3:
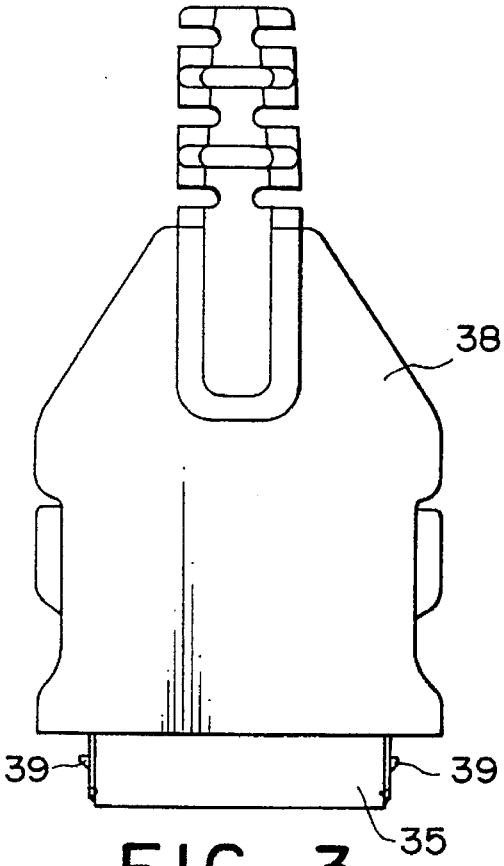
FIG. 3 PRIOR ART
FIG. 3 is a front view of a third conventional shielded connector having a shield case.
Figure 4:
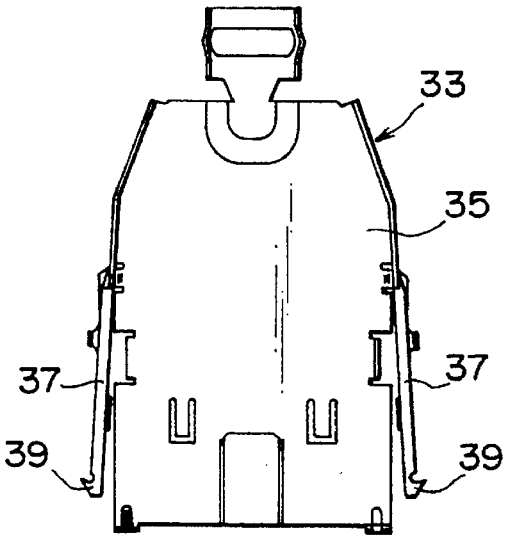
FIG. 4 PRIOR ART
FIG. 4 is a front view of the shielded connector illustrated in FIG. 2, in which the shield case is removed.
Figure 5A:
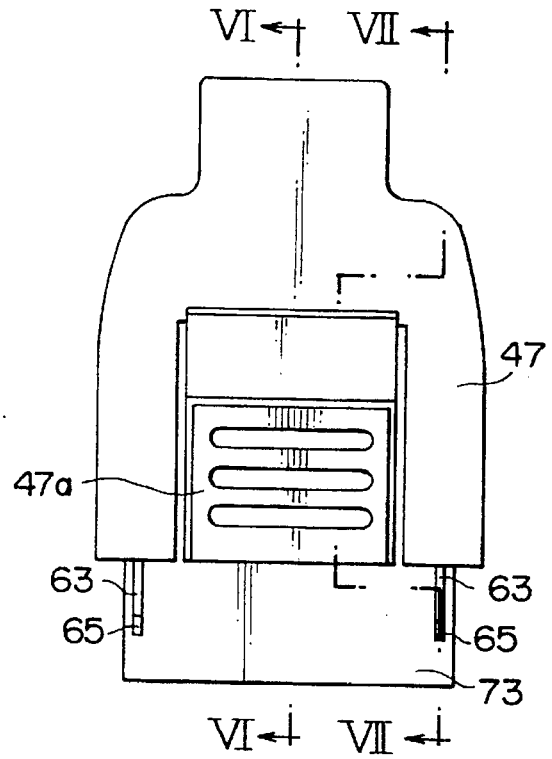
FIG. 5A is a front view of a shielded connector according to an embodiment of this invention.
Figure 5B:
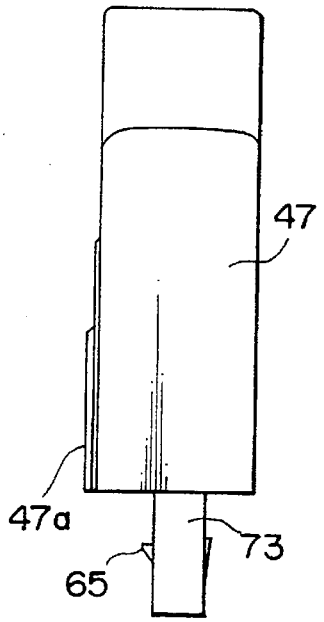
FIG. 5B is a side view of the shielded connector of FIG. 5A.
Figure 5C:
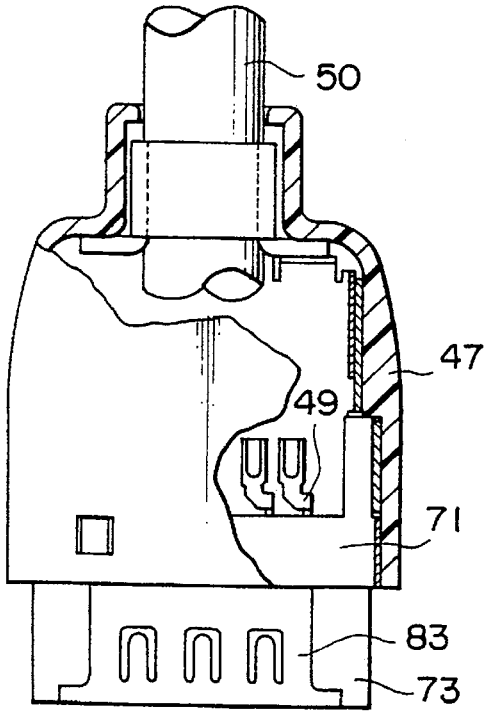
FIG. 5C is a a partially cut-away rear view of the shielded connector of FIG. 5A.

Referring to FIGS. 3 and 4, the description will be directed to a third conventional shielded connector. In the third conventional shielded connector, a shell 33 has a shell body 35 and a pair of movable members 37 integrally connected to the shell body 35 at approximate centers of opposite side surfaces of the shell body 35. The movable members 37 are urged outwardly. The shell 33 is covered with a hood 38. In FIGS. 3 and 4, each of reference numerals 39 represents a hook which is for being engaged with each of locking holes of a mating connector which is not illustratedin the figures.

Referring to FIGS. 5A, 5B, 5C, 6, 7, and 8, the description will be made as regards a shielded connector according to an embodiment of this invention. The shielded connector is for being electrically connected to a mating connector in a first direction. The mating connector is represented by a reference numeral 40 in FIG. 9 and comprises a peripheral wall 40*a* of metal defining a receiving hole 40*b* and having a pair of locking holes 40*c*.

Figure 6:
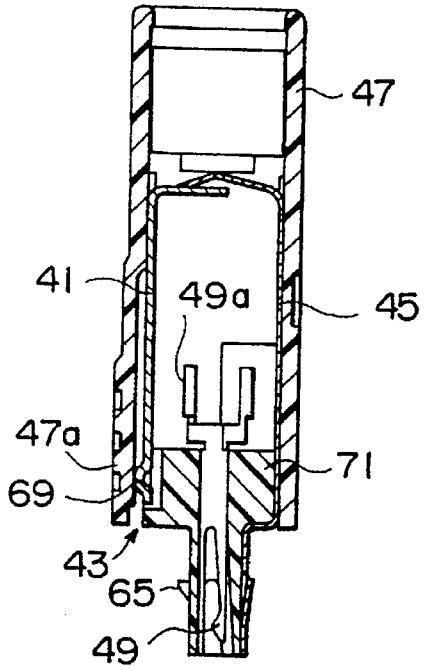
FIG. 6 is a sectional view taken along a line VI—VI in FIG. 5A.
Figure 7:
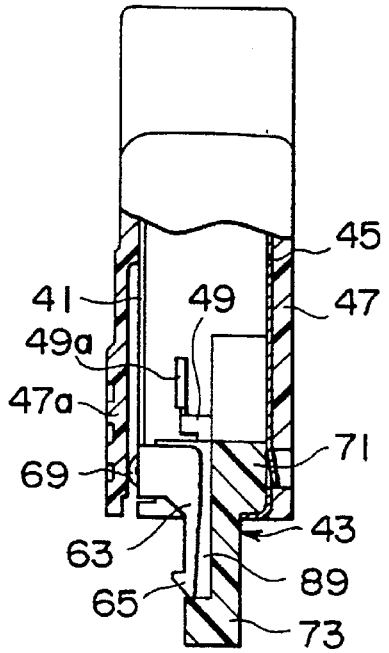
FIG. 7 is a sectional view taken along a line VII—VII in FIG. 5A.
Figure 8:
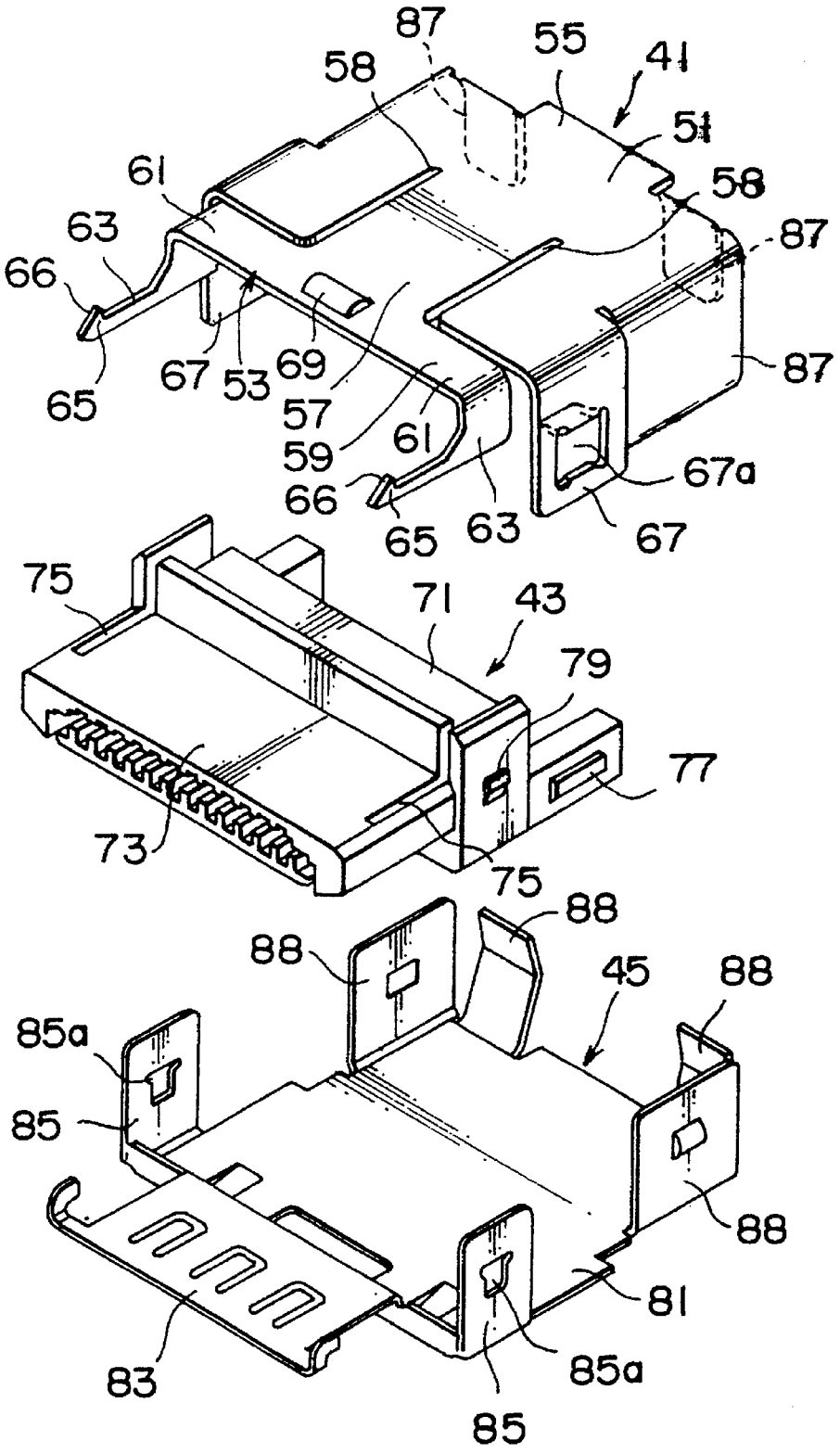
FIG. 8 is an exploded perspective view of a main portion of the shielded connector illustrated in FIGS. 5A through 5C.

In the manner which will presently be described, the shielded connector comprises a front shell 41, an insulator 43, a back shell 45, and a hood 47. The insulator 43 is made of plastic material and fixedly holds a plurality of contact members 49 only one of which is illustrated in FIG. 6. The contact members 49 have conductivity and are arranged at a predetermined pitch in a second direction or a width direction which is perpendicular to the first direction. Each of the contact members 49 has a connection portion 49*a* electrically connected to a cable 50 between the front and the back shells 41 and 45.

The front shell 41 is made of a metal plate and comprises a shielding portion 51 and a lock spring or a coupling portion 53 formed integral with the shielding portion 51. The shielding portion 51 is for covering the insulator 43 to electromagnetically shield the contact members 49 and has a principal portion 55 extending in the first and the second directions. The coupling portion 53 is for being mechanically coupled to or locked up by the mating connector 40 in the first direction and comprises a spring portion 57 and an engaging portion 59. The spring portion 57 extends from the principal portion 55 in the first direction with gaps 58 between the spring portion 57 and the principal portion 55 to have a spring-extended end. The spring portion 57 is elastically bendable in a first plane extending in the first direction and a third direction or a thickness direction which is perpendicular to the first and the second directions. The engaging portion 59 is formed integral with the spring-extended end for being brought in engagement with the mating connector 40 in the first direction in the manner which will later be described.

The engagfng portion 59 comprises a pair of arm portions 61, a pair of hook portions 63, and a pair of engaging nails 65. The arm portions 61 extend opposite to each other from the spring-extended end in the second directi6n to have armlextended ends. The hook portions 63 extend from the arm-extended ends in the first direction, respectively. The engaging nails 65 protrude from the hook portions 63 in the third direction and are for being inserted in the locking holes 40*c* of the mating connector 40 in the manner which will later be described. Each of the engaging nails 65 has a slant face 66 which is slanting to the first and the third directions.

The shielding portion 51 further comprises a pair of side portions 67 extending in parallel to the first plane that is perpendicular to the principal portion 55. Each of the side portions 67 has an engaging hole 67*a*. A protrusion 69 is formed in the vicinity of the main extended end of the spring portion 57.

The insulator 43 comprises an insulator body 71 and a fitting portion 73 which is formed integral with the insulator body 71 and is for being fitted into the mating connector. The fitting portion 73 is provided with a pair of grooves 75 in the vicinity of side surfaces of the insulator 43 in the second direction. Each of the grooves 75 extends in the first direction and is for receiving each of the hook portions 63 of the front shell 41. When received in the grooves 75, the hook portions 63 are prevented from movement thereof in the second direction. First and second locking protrusions 77 and 79 are formed on each of the side surfaces of the insulator 43. The first locking protrusion 77 is for being inserted in the engaging hole 67*a* of the front shell 41 to beengaged with each of the side portions 67 when the front shell 41 is attached to the insulator 43. The second locking portion 79 has operation which will later become clear.

The back shell 45 is formed independent of the front shell 41 from a metal plate and coupled to the insulator 43 to electromagnetically shield the contact members 49 in cooperation with the front shell 41. The back shell 45 will be referred to as ashielding member.

The back shell 45 comprises a principal portion 81 covering the insulator body 71, a proJecting portion 83 covering the fitting portion 73, and a pair of side surface portions 85 covering the side surfaces of the insulator body 71. Each of the side surface portions 85 has an engaging hole 85*a* which is for receiving the second locking protrusion 79. When the engaging hole 85*a* receives the second locking protrusion 79, each of the side surface portions 85 is engaged with the second locking protrusion 79 in the first and the third directions.

Furthermore, the front shell 41 is provided with a plurality of side walls 87 which is perpendicular to the principal portion 55 of the front shell 41. On the other hand, the back shell 45 is provided with a plurality of side wails 88 perpendicuiar to the principal portion 81 of the back shell 45. The side walls 87 and 88 serve to electromagnetically shield the contact imembers 49.

Now, description will be directed to an assembling process of the above-mentioned components. A first, the back shell 45 is attached to the insulator 43 to be brought into tight contact with the rear surface of the insulator 43. The front shell 41 is assembled on the insulator 43. At this time, the hook portions 63 of the coupling portion 53 are received in the grooves 75 with the engaging nails 65 protruding from the grooves 75. It is to be noted that the grooves 75 have bottoms which are apart from the hook portions 63, respectively. In other words, a particular gap 89 is left between each of the hook portions 63 and each of the bottoms of the grooves 75.

Subsequently, the hood 47 is attached to cover the front and the back shells 41 and 45. Thus, the shielded connector is completed. The hood 47 is made of plastic material and has an elastic portion 47*a* which is in contact with the protrusion 69 and is elastically bendable in the first plane.

Figure 9:
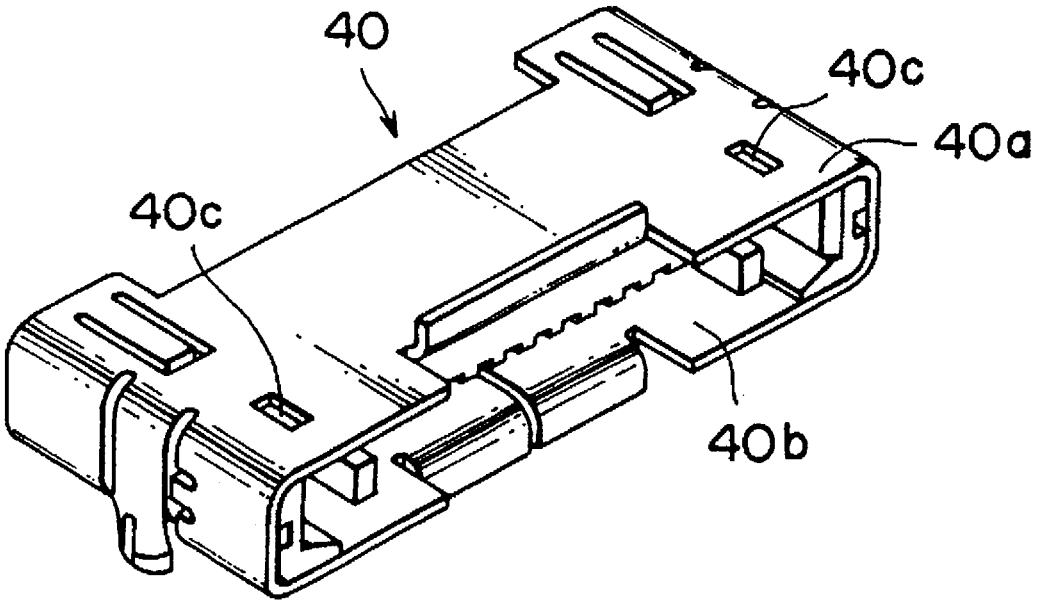
FIG. 9 is a perspective view of a mating connector which is connected to the shielded connector illustrated in FIGS. 5A through 5C.
Figure 10A:
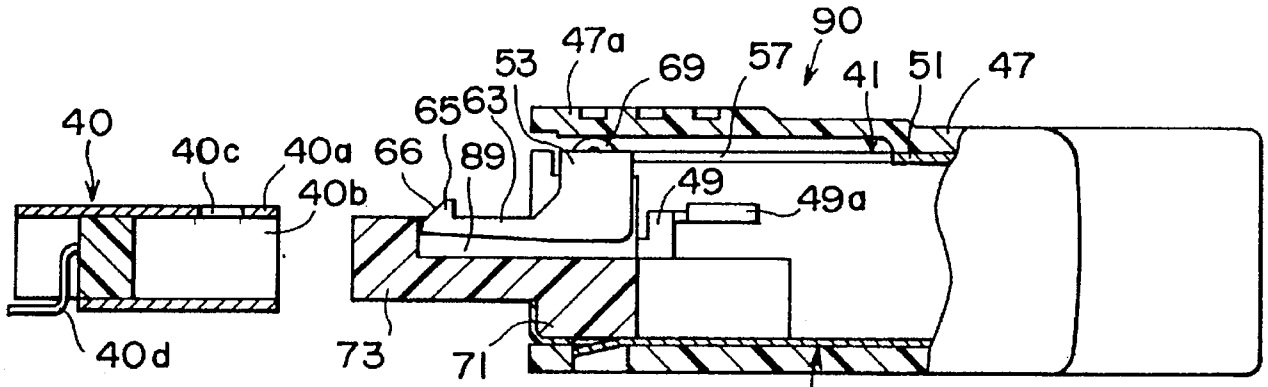
FIG. 10A is a sectional view of a condition where the shielded connector of FIGS. 5A through 5C is disconnected from the mating connector of FIG. 9.
Figure 10B:
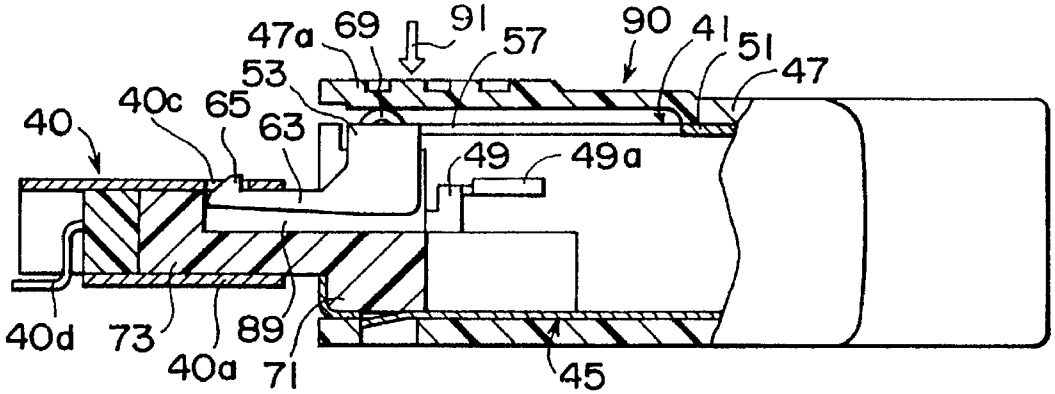
FIG. 10B is a sectional view of a condition Where the shielded connector of FIGS. 5A through 5C is connected to the mating connector of FIG. 9.

Referring to FIGS. 10A and 10B together with FIG. 9, the description will be directed to operation which is for connecting the shielded connector with the mating connector 40. In FIG. 10A, the shielded connector is represented by a reference numeral 90 and is disconnected from the mating connector 40. In this condition, the engaging nails 65 are protruded from the grooves 75 with the particular gap 89 left therebetween. In order to connect the shielded connector 90 with the mating connector 40, the fitting portion 73 is inserted into the receiving hole 40*b*. In a process of insertion of the fitting portion 73 into the receiving hole 40*b*, the slant face 66 is brought in press contact with an end portion of the peripheral wall 40*a*. This results in pushing the engaging nails 65 into the grooves 75. Therefore, the shielded connector 90 can be connected to the mating connector 40 with the fitting portion 73 inserted into the receiving hole 40*b*.

When the shielded connector 90 is conhected to the mating connector 40 as illustrated in FIG. 10B, the engaging nails 65 are inserted in the locking holes 40*b* to be engaged with the peripheral wall 40*a* of the mating connector 40 in the first direction. As a result, the shielded connector 90 is mechanically connected to or tightly locked up by the mating connector 40. In this event, it is a matter of course that the contact members 49 of the shielded connector 90 are brought in contact with contact members 40*d* of the mating connector 40.

In order to disconnect the shielded connector 90 from the mating connector 40, the elastic portion 47*a* is pushed towards the protrusion 69 as depicted by an arrow mark 91 in FIG. 10B. This results in bending of the spring portion 57 to make the engaging nails 65 become out of the locking holes 40*c*. Therefore, the shielded connector 90 can readily be disconnected from the mating connector 40 by applying opposite force therebetween. This is because the engaging nails 65 are not engaged with the peripheral wall 40*a* of the mating connector 40 in the first direction.

The shielded connector can be designed to have a size which is relatively small in the second direction so as to achieve miniaturization of the connector. In addition, the coupling portion 53 is formed integral with the shielding portion 51, so that the number of parts is reduced and that manufacture is easy. It is therefore possible to reduce the cost.

While the present invention has thus far been described in connection with a few embodiments thereof, it will readily be possible for those skilled in the art to put this invention into practice in various other manners. For example, the engaging portion may comprise three or more engaging nails.

What is claimed is:

1. A shielded connector for being connected to a matinq connector responsive to a motion in a first direction, said connector including an insulator, a plurality of conductive contact members held to said insulator to be arranged in a second direction perpendicular to said first direction, and a shell made of a metal plate and held to said insulator, said shell comprising:

a shielding portion coverinq said insulator to electromaqnetically shield said contact members, said shielding portion having a principal portion extendinq in said first and said second directions; and a coupling portion formed inteqrally with said shielding portion for being mechanically coupled to said mating connector by acting in said first direction, said coupling portion being movable in substantially a third direction perpendicular to said first and said second directions;

said coupling portion comprising:

a spring portion extending from said principal portion in said first direction to provide a spring-extended end, said spring portion being elastically bendable in a first plane extending in said first direction and a third direction which is perpendicular to said first and said second directions; and an engaging portion formed integrally with said spring-extended end for being brought into engagement with said mating connector responsive to motion in said first direction;

said engaging portion comprising:

an arm portion extending from said spring-extended end in said second direction to have an arm-extended end;

a hook portion extending from said arm-extended end in said first direction; and an engaging nail protruded form said hook portion in said third direction.

2. A shielded connector as claimed in claim 1, wherein said insulator has a groove which extends in said first direction and is provided for receiving said hook portion in order to prevent said hook portion from being moved in said second direction.

3. A shielded connector as claimed in claim 1, wherein said shell further comprises a shielding member which is formed independently of said shielding and said coupling portions and is coupled to said insulator in order to electromagnetically shield said contact members in cooperation with said shielding and said coupling portions.

4. A shielded connector as claimed in claim 3, further comprising a hood which is made of insulating material and covers said shell.

* * * * *

UNITED STATES PATENT AND TRADEMARK OFFICE

CERTIFICATE OF CORRECTION

PATENT NO. : 5,660,558
DATED : August 26, 1997
INVENTOR(S) : Yutaka Osanai; Hideyuki Ohtani; Yasufumi Hayashi It is certified that error appears in the above-identified patent and that said Letters Patent is hereby corrected as shown below:

In the Abstract:

Line 3, delete "whichis" and insert --which is--.
Line 8, delete "dontact" and insert --contact--.
Line 10, delete "perpendicularto" and insert --perpendicular to--.

Column 1, Line 27, delete "manner Which" and insert --manner which--.

Column 1, Line 64, delete "connetor" and insert --connector--.

Column 2, Line 31, delete "condition Where" and insert --condition where--.

Column 2, Line 38, delete "description Will" and insert --description will--.

Column 2, Line 56, delete "ektending" and insert --extending--.

Column 2, Line 61, delete "inengagement" and inset --in engagement--.

Column 3, Line 24-25, delete "illustratedin" and insert --illustrated in--.

Column 3, Line 66, delete "engagfng" and insert --engaging--.

Column 4, Line 2, delete "directi6n" and insert --direction--.

Column 4, Line 3, delete "armlextended" and insert --arm-extended--.

UNITED STATES PATENT AND TRADEMARK OFFICE

CERTIFICATE OF CORRECTION

PATENT NO. : 5,660,558
DATED : August 26, 1997
INVENTOR(S) : Yutaka Osanai; Hideyuki Ohtani; Yasufumi Hayashi It is certified that error appears in the above-indentified patent and that said Letters Patent is hereby corrected as shown below:

Column 4, Line 31, delete "portion" and insert --protrusion--.

Column 4, Line 36, delete "ashielding" and insert --a shielding--.

Column 4, Line 38, delete "proJecting" and insert --projecting--.

Column 4, Line 50, delete "side wails 88" and insert --side walls 88--.

Column 4, Line 51, delete "perpendicuiar" and insert --perpendicular--.

Column 4, Line 53, delete "imembers" and insert --members--.

Column 4, Line 55, delete "A first" and insert --At first--.

Column 5, Line 20, delete "conhected" and insert --connected--.

Column 5, Line 22, delete "locking holes 40b" and insert --locking holes 40c--.

Column 6, Line 9, delete "coverinq" and insert --covering--.

Column 6, Line 9-10, delete "electromaqnetically" and inset --electromagnetically--.

Column 6, Line 11, delete "extendinq" and insert --extending--.

Column 6, Line 13, delete "inteqrally" and insert --integrally--.

UNITED STATES PATENT AND TRADEMARK OFFICE

CERTIFICATE OF CORRECTION

PATENT NO. : 5,660,558
DATED : August 26, 1997
INVENTOR(S) : Yutaka Osanai; Hideyuki Ohtani; Yasufumi Hayashi It is certified that error appears in the above-indentified patent and that said Letters Patent is hereby corrected as shown below:

Column 6, Line 36, delete "protruded form said" and insert --protruding from said--.

Column 6, Line 49, delete "claimed in claim 3" and insert --claimed in claim 1--.

Signed and Sealed this

Twentieth Day of January, 1998

Bruce Lehman

*Attest:*

BRUCE LEHMAN

*Attesting Officer*

*Commissioner of Patents and Trademarks*